US010768576B2

(12) United States Patent
Bonvin et al.

(10) Patent No.: US 10,768,576 B2
(45) Date of Patent: Sep. 8, 2020

(54) MECHANISM FOR REWINDING AND/OR CORRECTING AT LEAST ONE CLOCK FUNCTION AND DEVICE FOR SELECTING A CLOCK FUNCTION

(71) Applicant: ROLEX SA, Geneva (CH)

(72) Inventors: Nicolas Bonvin, Châtelaine (CH); Vincent Lemosquet, Bons-en-Chablais (FR); Denis Rudaz, Segny (FR); Pierre Villaret, Villy le Pelloux (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/562,548

(22) PCT Filed: Apr. 1, 2015

(86) PCT No.: PCT/EP2015/057185
§ 371 (c)(1),
(2) Date: Sep. 28, 2017

(87) PCT Pub. No.: WO2016/155814
PCT Pub. Date: Oct. 6, 2016

(65) Prior Publication Data

US 2018/0107163 A1 Apr. 19, 2018

(51) Int. Cl.
*G04B 27/02* (2006.01)
*G04B 27/06* (2006.01)

(52) U.S. Cl.
CPC ..... *G04B 27/02* (2013.01); *G04B 27/06* (2013.01)

(58) Field of Classification Search
None
See application file for complete search history.

(56) References Cited

U.S. PATENT DOCUMENTS 3,848,400 A 11/1974 Fluck et al.
4,112,673 A * 9/1978 Gilomen ..... G04B 27/02 368/196
5,963,511 A 10/1999 Huter
6,711,099 B1 3/2004 Mock et al.
7,980,756 B2 7/2011 Graemiger et al.
8,328,414 B2 12/2012 Graemiger et al.
(Continued)

FOREIGN PATENT DOCUMENTS

CH 572 236 B5 1/1976
CH 702 548 A2 7/2011
(Continued)

OTHER PUBLICATIONS

International Search Report and Written Opinion dated Mar. 7, 2016 issued in corresponding application No. PCT/EP2015/057185; w/ English partial translation and partial machine translation (25 pages).
(Continued)

*Primary Examiner* — Daniel P Wicklund
(74) *Attorney, Agent, or Firm* — Seckel IP, PLLC

(57) ABSTRACT

Device (400) for selecting a clock function from a rewinding function and m correction functions, m>1, comprising a control member (3), notably a staff, able to select the rewind function by movement of the control member in a first direction and to select sequentially one function from m correction functions by movement of the control member in a second direction.

19 Claims, 8 Drawing Sheets

(56) References Cited

U.S. PATENT DOCUMENTS

| | | | | |
|---|---|---|---|---|
| 2009/0010109 | A1 | 1/2009 | Graemiger et al. | |
| 2011/0242947 | A1 | 10/2011 | Graemiger et al. | |
| 2014/0056114 | A1 | 2/2014 | Monferrer et al. | |
| 2014/0177397 | A1* | 6/2014 | Rudaz | G04B 27/04 368/32 |
| 2014/0321247 | A1* | 10/2014 | Cattaneo | G04B 19/223 368/27 |
| 2016/0124388 | A1 | 5/2016 | Neboisa et al. | |

FOREIGN PATENT DOCUMENTS

| | | | | |
|---|---|---|---|---|
| EP | 0 816 954 | A1 | 1/1998 | |
| EP | 2 012 199 | A2 | 1/2009 | |
| EP | 2 367 074 | A1 | 9/2011 | |
| EP | 2 444 861 | A1 | 4/2012 | |
| EP | 2 701 015 | A1 | 2/2014 | |
| JP | 2006-266700 | A | 10/2006 | |
| JP | 2009-014722 | A | 1/2009 | |
| JP | 2014-041125 | A | 3/2014 | |
| WO | 00/62130 | A1 | 10/2000 | |
| WO | WO-2012175595 | A1 * | 12/2012 | G04B 27/04 |
| WO | 2014/166798 | A2 | 10/2014 | |

OTHER PUBLICATIONS

Japanese Office Action dated Jan. 15, 2019 in counterpart JP application No. 2017-551055; w/ English translation (6 pages).

* cited by examiner

MECHANISM FOR REWINDING AND/OR CORRECTING AT LEAST ONE CLOCK FUNCTION AND DEVICE FOR SELECTING A CLOCK FUNCTION

BACKGROUND ART

The invention relates to a mechanism for the winding and/or correction of at least one horological function. The invention further relates to a device for selecting a horological function. It also relates to a watch movement comprising a suchlike device or a suchlike mechanism. It relates, finally, to a timepiece, in particular a wristwatch, comprising a suchlike device or a suchlike mechanism or a suchlike movement.

An interface mechanism provided for selecting and actuating one or other of at least two horological functions is already known. Suchlike devices are known and used in numerous wristwatches, whether they be simple watches or those which provide an indication derived from the time, such as the dates of the month, the days of the week or even the various time zones. The control of these various functions generally requires the axial displacement of the control stem into at least two distinct positions. A first position may permit manual winding, a second intermediate position may permit the correction of the dates, and a third position may permit the adjustment of the time.

In practical terms, this is the limit of the functions and/or the time indications that can be adjusted with a suchlike control stem, insofar as it is difficult to position the stem in the intermediate positions, and it is necessary to memorize the axial positions of the stem that are dedicated to each of the control functions.

The usual mechanisms include a sliding pinion which is intended to be displaced axially in at least two distinct positions in order to be brought into engagement alternately with the winding train and the various correction trains by means of horizontal clutch devices requiring the involvement of a large number of levers. The kinematics of the different wheel trains moving parallel to the movement frame element is complicated and may give rise to problems of penetration of toothing one into the other, which are manifested as problems of butting, wear and random sensations at the stem. There is thus a risk of axial blocking of the stem and untimely correction of the indications.

Document CH572236 discloses a conventional mechanism having three stem positions, which is characteristic of the mechanisms equipped with horizontal clutch devices controlled by a sliding pinion.

Patent Application CH702548 discloses a mechanism equipped with horizontal clutch mechanisms, of which the control system has been adapted for the purpose of rendering it sequential notably by means of a column wheel. The selection of at least two functions is effected by the application of successive pressures to the winding crown, and the correction of the selected function is effected by the rotation of the said crown. This construction does not allow the aforementioned disadvantages of the conventional mechanisms to be addressed. Furthermore, the interface resulting therefrom requires a display of the selected function and consequently has an aesthetic impact on the wristwatch equipped with a suchlike mechanism.

Patent Application EP2367074 discloses a sequential mechanism, of which the selection of the functions is effected by the application of successive pressures to a selector means, and the correction of the selected function is effected by the rotation of an adjustment crown. A clutch device dedicated to the correction functions takes the form of an epicyclic gear train, of which the sun wheel is rotationally fixed to the adjustment crown. Planetary gears are pivoted on a planetary gear carrier in such a way as to be brought into engagement with one or other of the correctors, each corresponding to a specific correction train. The selection of the correction functions of this mechanism is thus defined by the angular position of the planetary gear carrier which is controlled by the selector means. A suchlike device allows the correction functions to be multiplied by adjusting the size and the arrangement of the planetary gears and the planetary gear carrier wheel. However, this has the disadvantage of generating a risk of orbiting of the setting wheels, which results in the random displacement of one or more indications in the course of the transition from one correction function to another. Furthermore, the interface which derives from a suchlike mechanism requires a number of control members and has an aesthetic impact on the wristwatch equipped with a suchlike mechanism.

Patent Application EP2444861 similarly relates to a mechanism, of which the clutch device is implemented by an epicyclic gear train. This makes it possible to select at least two distinct functions by the application of successive pressures to a control stem and to actuate the selected function by the rotation of the said stem. The planetary wheel of the epicyclic gear train in this case is rotationally fixed to the control stem by means of a return spring, which allows a degree of freedom to be provided between the stem and the correctors and thereby permits the risks of butting and the risks of orbiting when selecting the functions to be avoided a priori. In return, however, a suchlike design introduces a dead angle into the correction trains, which may result in a reduction in the correction speed after selection of the function in question.

SUMMARY OF THE INVENTION

The aim of the invention is to provide a device making it possible to address the aforementioned disadvantages and to improve the devices known from the prior art. In particular, the invention proposes a simple mechanism allowing the number of correction functions at the stem to be multiplied and the selection of these functions to be simplified. The invention also proposes a selection device allowing this aim to be accomplished.

A selection device according to a first aspect of the invention is defined by the following point 1.

1. A device for selecting a horological function from among a winding function and m correction functions, m>1, comprising a control member, notably a stem, adapted to select the winding function by displacement of the control member in a first direction and to select sequentially one function from among m correction functions by displacement of the control member in a second direction.

Different embodiments are defined by the following points 2 to 12.

2. The device as defined in the preceding point, wherein the selection device comprises a wheel set rotatably mounted on a frame element, of which the direction of rotation is determined by the direction of translation of the control member.
3. The device as defined in one of the preceding points, wherein it comprises a member for driving the wheel set sequentially in a first direction.
4. The device as defined in the preceding point, wherein the driving member comprises a first lever, notably a pull-out piece, a second lever and a third lever, notably a third lever pivoted on the second lever or a finger pivoted on the second lever.

5. The device as defined in the preceding point, wherein it comprises a first return spring so arranged as to return the first lever and the control member to a rest position.
6. The device as defined in points 4 or 5, wherein it comprises a second return spring so arranged as to return the third lever to a rest position.
7. The device as defined in points 3 to 6, wherein the wheel set comprises toothing so arranged as to interact with the sequential drive member, notably with the third lever or finger.
8. The device as defined in one of points 3 to 7, wherein it comprises a pawl for indexing the wheel set into position.
9. The device as defined in point 8, wherein the indexing pawl is so arranged as to interact with the second lever, notably being so arranged that the actuation of the second lever on the pawl deactivates the pawl.
10. The device as defined in one of the preceding points, wherein it comprises an element for returning the wheel set to a rest position.
11. The device as defined in one of the preceding points, wherein the control member is monostable.
12. The device as defined in one of the preceding points, wherein it is so arranged that a translatory actuation of the arbor, in the direction of pushing against the arbor, causes the activation of the watch winding function, or wherein it is so arranged that a translatory actuation of the arbor, in the pulling direction of the arbor, causes the activation of a watch correction function.

A mechanism according to the first aspect of the invention is defined by the following point 13.

13. A mechanism for winding and/or correcting at least one horological function comprising a control wheel for winding and/or correcting respectively in direct and permanent engagement with a movable member and with n wheels, n>1, preferably n>2, each wheel being part of a kinematic train for correction or winding, each kinematic train comprising a clutch, at least n−1 clutches being of the vertical type, the mechanism comprising a device as defined in one of the preceding points.

A movement according to the first aspect of the invention is defined by the following point 14.

14. A watch movement comprising a mechanism as defined in the preceding point or a device as defined in one of points 1 to 12.

A watch according to the first aspect of the invention is defined by the following point 15.

15. A watch, in particular a wristwatch, comprising a mechanism as defined in point 13 and/or a device as defined in one of points 1 to 12 and/or a watch movement as defined in the preceding point.

A mechanism according to a second aspect of the invention permits at least one horological function to be wound and/or corrected. It comprises a control wheel for winding and/or correction respectively in direct and permanent engagement with a movable member and with n wheels, n>1, preferably n>2. Each wheel is part of a kinematic train for correction or winding. Each kinematic train comprises a clutch, at least n−1 clutches being of the vertical type.

The member may comprise at least one arbor, notably a stem, movably mounted axially in translation.

The axis of rotation of the correction and/or winding wheel and the axis of translation of the arbor may be concurrent or substantially concurrent and perpendicular or substantially perpendicular.

The movable member may comprise a pinion, the n correction and/or winding wheels being in permanent engagement with the pinion, which is rotationally fixed to the arbor.

The mechanism may comprise a selection device including the arbor and a wheel set mounted in rotation on a frame, the position of the wheel set being determined by the arbor, the position of the wheel set determining the state of activation or non-activation of the clutches.

The rotation of the wheel set may be bidirectional, and a drive member may link the arbor and the wheel set kinematically.

The wheel set may control a horizontal clutch wheel set.

The wheel set may comprise recesses and/or openings and/or slopes inclined relative to the plane of a movement frame element and intended to interact by contact with clutch arbors in such a way as to activate or deactivate clutches.

At least one clutch of the vertical type may comprise at least one wheel that is movable in translation in its axis of rotation.

A kinematic train may comprise a clutch of the horizontal type.

A watch movement according to the second aspect comprises a mechanism as defined previously.

A watch, in particular a wristwatch, according to the second aspect comprises a mechanism as defined previously and/or a watch movement as defined previously.

All the combinations of characterizing features of the first and second aspects are envisaged.

BRIEF DESCRIPTION OF THE DRAWINGS

FIG. 1 is a top view of an exemplary embodiment of a mechanism for the winding and/or correction of at least one horological function and exemplary embodiment of a device for selecting a horological function according to the invention.

FIG. 2 is a perspective view of the mechanism of FIG. 1.

FIG. 3 is a perspective underside view of the mechanism of FIG. 1.

FIG. 4 is a vertical cross-sectional view of a portion of the mechanism of FIG. 1 along the interrupted line shown on FIG. 3.

FIG. 5 is a perspective view of another portion of the mechanism of FIG. 1.

FIG. 6 is a top view of the mechanism of FIG. 1 in a position before application of a pulling force.

FIG. 7 a top view of the mechanism of FIG. 1 in a position upon application of a pulling force.

FIG. 8 a top view of the mechanism of FIG. 1 after application of the pulling force, in a position of disengagement of the winding train and engagement of a date correction function.

FIG. 9 is a vertical cross-sectional view of a portion of the mechanism of FIG. 1 in a position of engagement of the date correction function.

FIG. 10 is a vertical cross-sectional view of a portion of the mechanism of FIG. 1 in a position of disengagement of the winding train.

FIG. 11 is a vertical cross-sectional view of a portion of the mechanism of FIG. 1 in a position of disengagement of the date correction function and engagement of a second calendar indication.

FIG. 12 is a vertical cross-sectional view of a portion of the mechanism of FIG. 1 in a position of disengagement of the second calendar indication and engagement of a time-setting train.

FIG. 13 is a top view of the mechanism of FIG. 1 in a position before application of a pushing force.

FIG. 14 a top view of the mechanism of FIG. 1 in a position upon application of the pushing force.

FIG. 15 a top view of the mechanism of FIG. 1 after application of the pushing force, in a position of disengagement of the time-setting train and engagement of the winding train.

DETAILED DESCRIPTION OF PARTICULAR EMBODIMENTS

Figure 1:
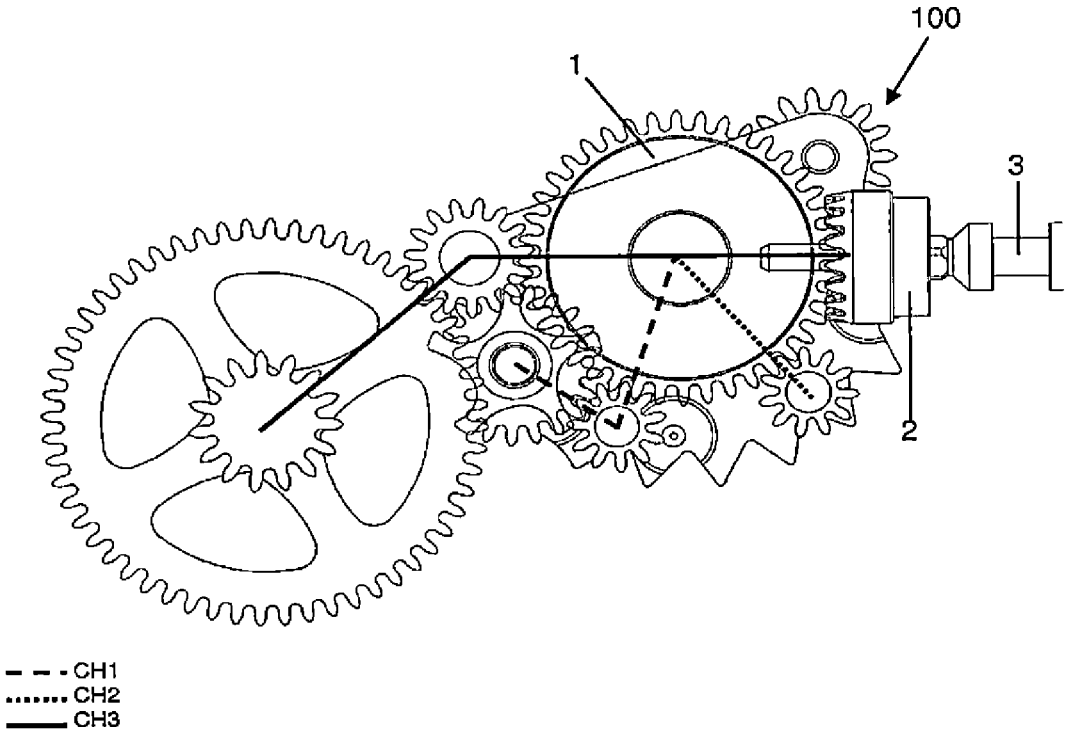
FIGS. 1 to 15 depict, by way of example, an embodiment of a mechanism for the winding and/or correction of at least one horological function and an embodiment of a device for selecting a horological function according to the invention.

An embodiment of a timepiece according to the invention is described below with reference to FIGS. 1 to 15. The timepiece is a watch 300, for example, notably a wristwatch. The timepiece comprises a watch movement 200, for example a mechanical movement. The watch movement 200 is depicted partially in FIG. 5, for example. The watch movement comprises a mechanism 100 for winding or correcting at least one horological function, notably a function for correcting the indication of the time and/or a function for correcting the display of a calendar indication. The mechanism may also comprise a device 400 for selecting a horological function from among a winding function and m correction functions, where m>1, notably m=2 or 3 or 4 or 5 or 6 and/or m=n, where n is a number of clutches of the vertical type.

The mechanism 100 for winding and/or correcting makes it possible to control at least one horological function for winding and/or correction. It makes it possible, notably, to wind the movement by winding a mainspring and/or to correct an indication, notably a calendar indication.

The winding and/or correction mechanism comprises a wheel 1, 1' for controlling the winding and/or correction in direct and permanent engagement with a movable member 3, 2 and with n wheels E1, E2, E3, E1', where n>1, preferably n>2. Each wheel is part of a kinematic train for correction or winding. Each kinematic train comprises a clutch D1, D2, D3, D1'. At least n−1 clutches from among the n clutches are of the vertical type. Notably, the n clutches may be of the vertical type.

The movable member preferably comprises at least one arbor, notably a stem 3, movably mounted axially in translation. The axis of rotation of the correction and/or winding wheel 1, 1' and the axis of translation of the arbor are substantially intersecting each other and/or are substantially perpendicular, for example.

The movable member preferably also comprises a pinion 2. The correction and/or winding wheel 1, 1' is in direct and permanent engagement with the pinion 2, which is rotationally fixed to the arbor 3, notably mounted square on the arbor 3. The pinion 2 is fixed in translation relative to a movement frame element, and the arbor 3 is able to move relative to the pinion 2.

The mechanism is provided with clutch devices, each of which is actuated by the arbor in such a way as to activate or deactivate one or other of the trains for winding and/or correcting the watch movement. The mechanism permits the installation of as many clutch devices D1 as there are winding and/or correction trains. For this purpose, these wheel trains are arranged in such a way as to be in direct and permanent engagement with a single control wheel 1, as depicted in FIG. 1. In the particular embodiment described in the figures, the control wheel 1 is linked kinematically to a single pinion 2, which is pivoted squarely on the arbor 3, and which is blocked axially relative to a frame element of the watch. The index i in the different numerical references uses the whole values 1 to N in order to distinguish N elements of the same nature one from the other. Thus, for example, for N=3, D1, D2 and D3 designate three distinct vertical clutch devices.

In the particular embodiment depicted here, there are as many vertical clutch devices D1 as there are trains for the correction of the display functions of the movement. The control of the different correction functions is possible thanks to a wheel set 4, notably a control cam 4, actuated in rotation by action on the arbor 3, which makes it possible to generate N times two levels of states 0.1 corresponding respectively to a state of non-activation and of activation of each of the N vertical clutches. Each clutch may thus be configured in an activated or engaged state or in a non-activated or disengaged state. Preferably, when one of the clutches is in an engaged state, the other clutches are each in a disengaged state. It is thus possible for N combinations of states to exist, in which a single vertical clutch is activated, and notably each of these N combinations corresponds to an angular position of the wheel set 4, hence N angular positions of the wheel set 4 corresponding to the N combinations.

The wheel set 4 may also ensure the operation of a horizontal clutch, as in the depicted embodiment.

Figure 2:
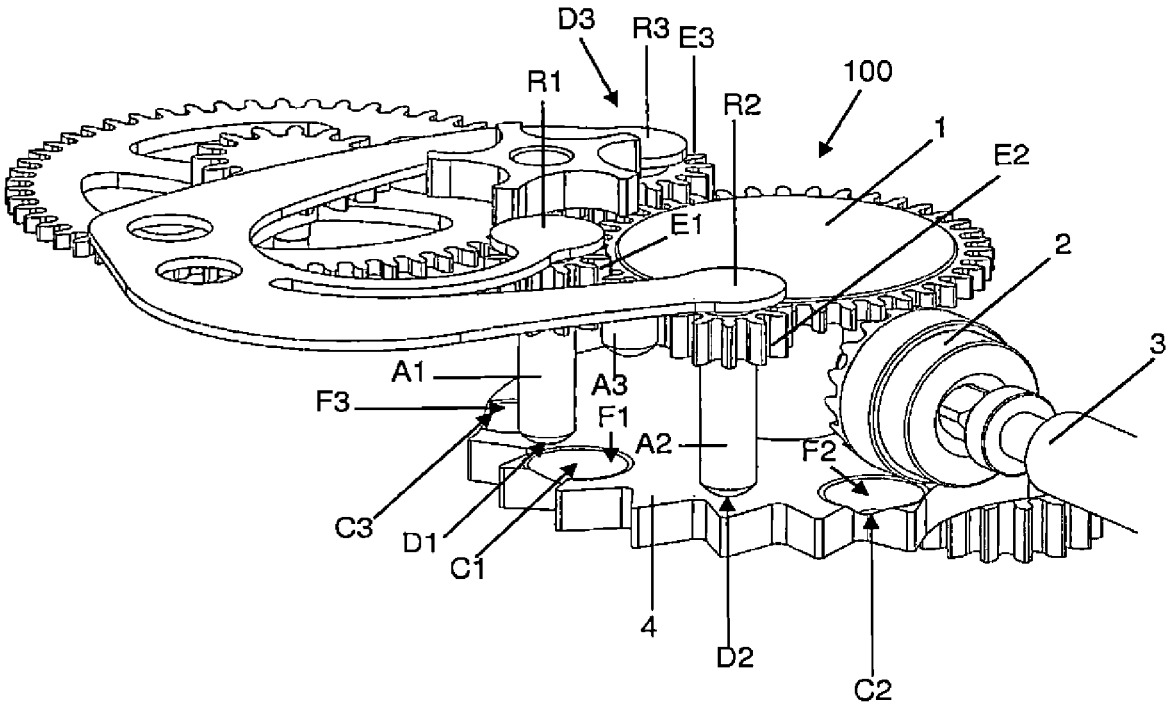

In order to ensure the operation or the control of the N vertical clutches dedicated to each of the trains for correcting the display functions of the movement in the particular depicted embodiment, the wheel set 4 is configured in such a way as to exhibit N recesses Ci, of which the flanks Fi are inclined relative to the plane of the movement frame element and are each intended to permit the activation of a specific clutch device, as depicted in FIG. 2. Each clutch device Di is provided with an input wheel Ei, which is constantly in engagement with the control wheel 1. The position of the axis of rotation of the input wheel Ei is fixed in the plane of the movement frame element. Depending on the actuation of the arbor 3, which determines the angular position of the wheel set 4, said input wheel Ei has the ability to come into engagement with the kinematic train that is associated with it by the axial displacement of a sliding arbor Ai that is integral with the input wheel and which is displaced axially under the influence of a return spring Ri. The recesses Ci and/or openings and/or slopes inclined relative to the plane of the movement frame element thus interact through contact with the arbors Ai of the clutches, in such a way as to activate or deactivate the clutches. In fact, the vertical clutches each comprise at least one wheel Ei that is movable in translation in its axis of rotation. The expression axis of rotation of a wheel Ei is intended to denote an axis of rotation that is fixed in relation to the wheel Ei which rotates around it, notably in relation to the wheel and to its arbor Ai which rotate around it.

The embodiment of the movement in this case includes three correction trains, namely a correction train for the dates CH1, a correction train for a second calendar indication CH2, as well as a train for setting the time of the timepiece CH3. The wheel set 4 is pivoted coaxially, for example, with the control wheel 1.

Figure 3:
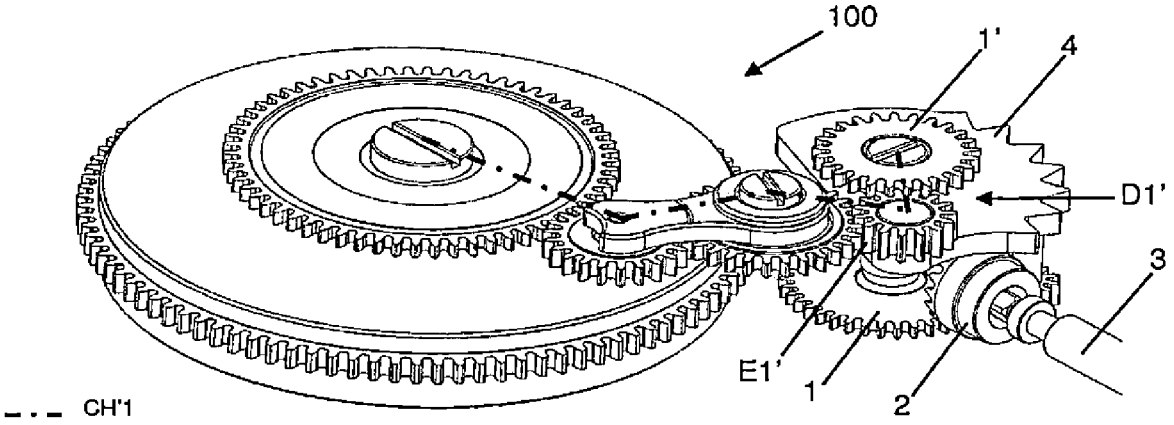

In the embodiment described here, a conventional winding train CH1' is engaged by a wheel E1', which is likewise in direct and permanent engagement with the control wheel 1 via an auxiliary control wheel 1', which is itself integral and which is pivoted on the wheel set 4 in such a way as to permit its displacement in the plane of the movement frame element, as depicted in FIG. 3. In the embodiment, the winding train may be thus activated by means of a horizontal clutch D1' controlled by the wheel set 4. The different wheel trains are thus activated by the rotation of the wheel set 4, and they are driven in rotation by the same control wheel 1. The activation of each correction train is determined by a distinct angular position of the wheel set 4.

Thus, in the particular embodiment described here, n wheels, notably four wheels E1, E2, E3, E1', are in direct and permanent engagement with the control wheel 1, among which n wheels, notably three wheels E1, E2, E3 are respectively part of a kinematic train, in particular a correction train CH1, CH2, CH3, each comprising a clutch D1, D2, D3 of the vertical type. In this particular embodiment, a wheel E1' is part of a kinematic train, notably a winding train CH1', comprising a clutch D1' of the horizontal type. It follows that, in this particular embodiment, N is equal to n−1. Alternatively, N may be equal to n if all the wheels that are in direct and permanent engagement with the control wheel are part of kinematic trains which are all activated by a clutch of the vertical type. In other words, the control wheel is in direct and permanent engagement with n wheels E1, E2, E3, E1', each wheel being part of a kinematic train for correction or winding, each kinematic train comprising a clutch D1, D2, D3, D1', at least n−1 clutches being of the vertical type.

Figure 4:
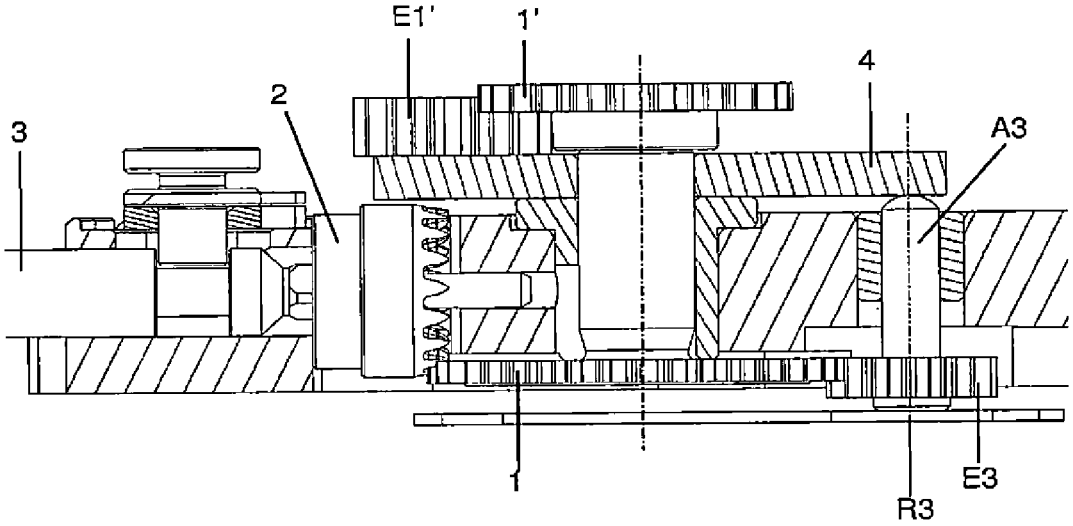

Advantageously, the wheels 1 and 1' are disposed to either side of the movement frame element. More advantageously, the wheel set 4 is pivoted between these two members, as depicted in FIG. 4.

In the embodiment depicted here, the wheel set 4 is displaced in rotation under the influence of the translation of the arbor 3. More specifically, the axial traction of the arbor makes it possible to select the functions for the correction of the timepiece sequentially, while an axial pressure on this arbor makes it possible to select the winding function sequentially. The axial pressure also makes it possible, simultaneously, to reset the sequence of selection of the correction functions. Thus, the device is so arranged that a translatory actuation of the arbor, in the direction of pushing against the arbor, causes the activation of the watch winding function and is so arranged that a translatory actuation of the arbor, in the pulling direction of the arbor, causes the activation of a correction function.

Advantageously, as in the case of conventional mechanisms with two or three positions, a suchlike interface permits winding of the watch after unscrewing or before screwing the stem crown. In order to permit these different selections, the mechanism comprises a device 400 for selecting a horological function from among, for example, a winding function and m correction functions, in particular three correction functions.

The selection device comprises a control member 3 such as the arbor, notably the stem. The device is thus capable of selecting the winding function by the displacement of the control member in a first direction, and of selecting a function sequentially from among m correction functions by the displacement of the control member in a second direction.

The selection device comprises the arbor 3 and the wheel set 4 rotatably mounted on the frame element. The position of the wheel set 4 is determined by the arbor and by the succession of displacements of the arbor. As described above, the position of the wheel set determines the state of activation or of non-activation of the clutches. In particular, the direction of rotation of the wheel set is determined by the direction of translation of the arbor. The rotation of the wheel set 4 is bidirectional.

For this purpose, the selection device comprises the arbor 3 actuating the wheel set 4 by means of a member 90 for driving the wheel set sequentially in a first direction.

Figure 5:
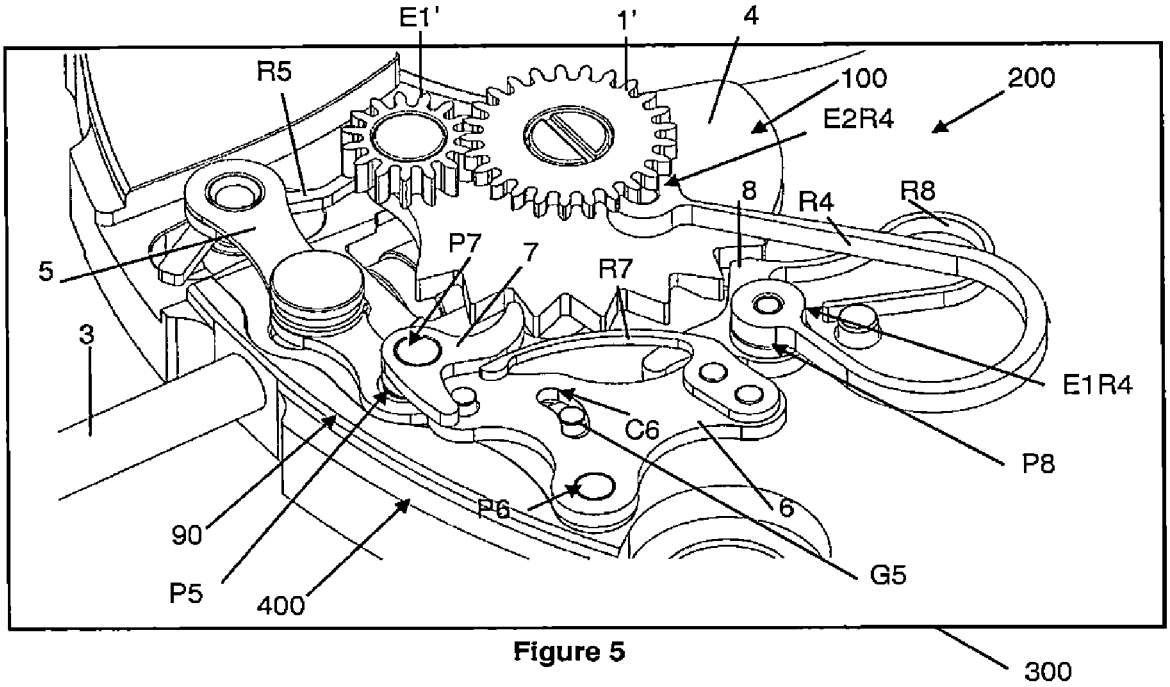

As depicted in FIG. 5, the driving member 90 comprises a first lever 5, notably a pull-out piece, a second lever 6 and a third lever 7, notably a third lever or a finger pivoted on the second lever.

The device comprises a first return spring R5 so arranged as to return the first lever and the control member to a rest position. The arbor and the first lever are thus monostable. The arbor and the first lever are also each capable of displacement to either side of the rest positions.

The device further comprises a second return spring R7 so arranged as to return the third lever, notably a finger, to a rest position.

The first lever is pivoted about an axis P5, and the third lever is pivoted about an axis P7 on the second lever. The springs R5 and R7 respectively make it possible to return the first lever and the third lever to rest positions.

Figure 6:
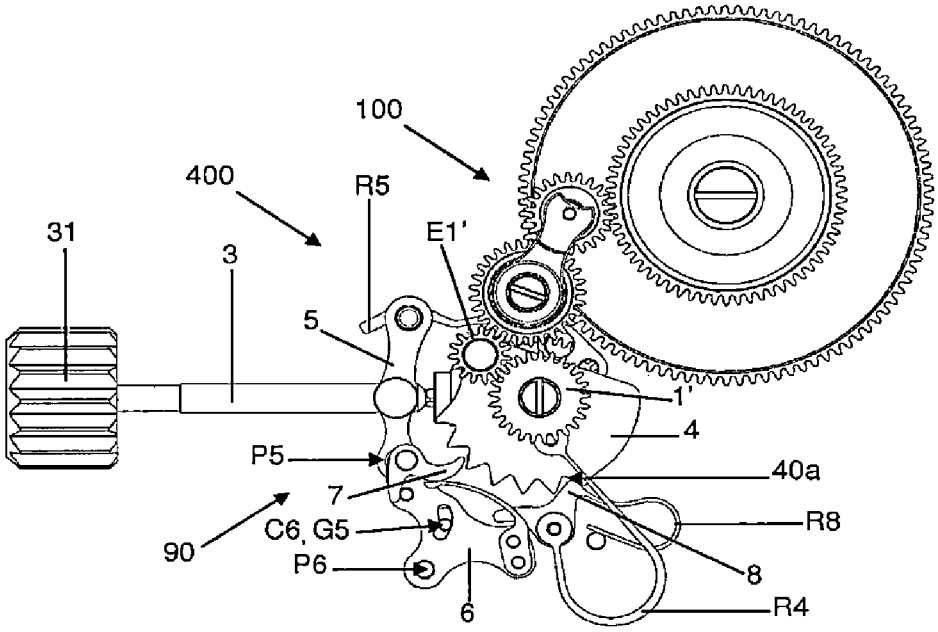

The arbor 3 is thus positioned in a stable manner by the spring R5 of the pull-out piece so as to permit the actuation of the winding function or correction function selected by the rotation of the wheel set 4. In this configuration, the angular position of the wheel set 4 is defined by an indexing pawl 8. The pawl is manufactured, for example, in a single piece with a return spring R8. FIG. 6 shows a suchlike configuration, the selected function being that for winding the movement. A beak of the pawl 8 in this case indexes a first tooth 40*a* of the wheel set 4. The device thus comprises a pawl 8 for indexing the wheel set 4 into position. The wheel set 4 therefore comprises a toothing 40 so arranged as to interact with the sequential drive member, notably with the third lever. The indexing pawl 8 is so arranged in addition as to interact with the second lever, notably being so arranged that the actuation of the second lever on the pawl deactivates the pawl.

Figure 7:
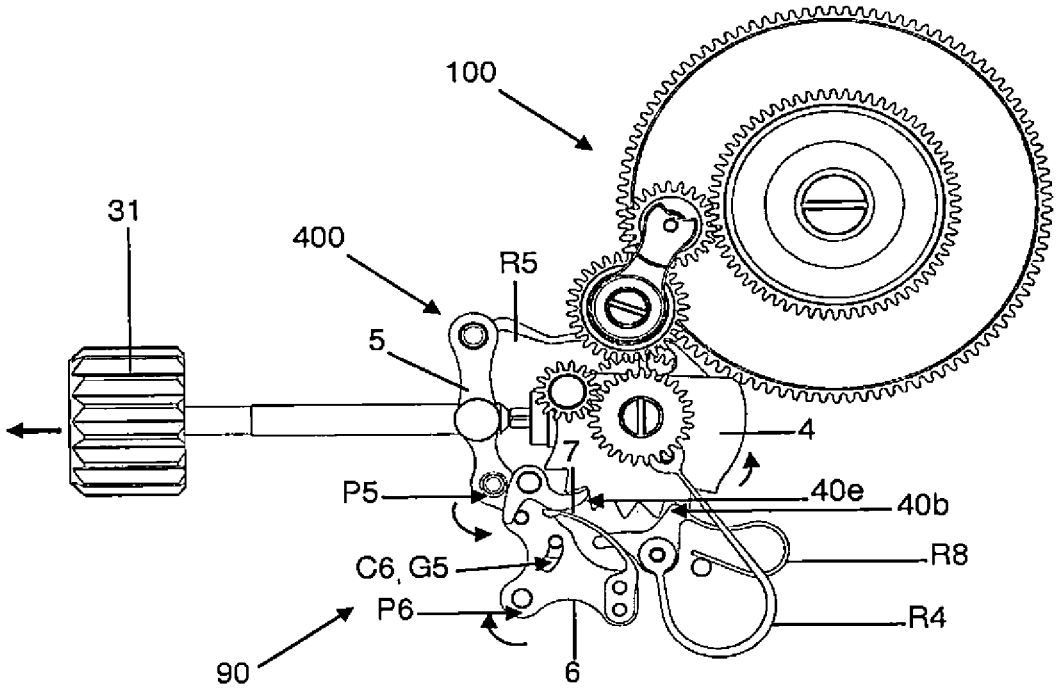
Figure 8:
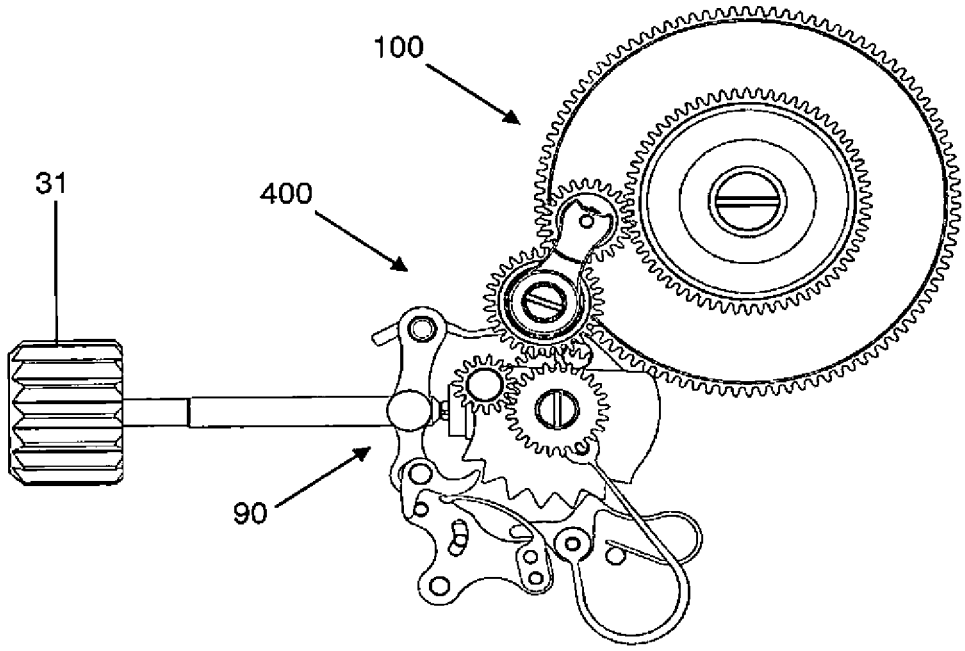

The application of a pulling force to the crown 31 that is integral with the arbor 3 induces the rotation of the first lever 5 about the pivot P5 through conventional means, and thereby causes the rotation of the second lever 6 about a pivot P6 under the influence of a pull-out piece pin G5, which is intended to interact with a path C6 for the lever 6, as depicted in FIG. 7. The finger 7 is thus driven on the lever 6 in order that its beak may interact with a tooth 40*e* of the wheel set 4, in such a way that the latter may be driven pivotably in a first direction of rotation on an angular pitch of the toothing 40, and thereby permits, for example, the disengagement of the winding train and the engagement of the date correction function, as depicted in FIG. 8.

The release of the stem crown causes the axial repositioning of the arbor 3 under the influence of the pull-out piece spring R5. During this repositioning, the first and second levers are likewise repositioned in their rest position. During this repositioning of the second lever, the finger is retracted under the action of a tooth of the wheel set 4. This is possible by the elastic deformation of the spring R7. FIG. 8 thus shows the mechanism in the position for selecting correction of the dates. The beak of the pawl 8 in this case indexes a second tooth 40*b* of the wheel set 4.

Figure 9:
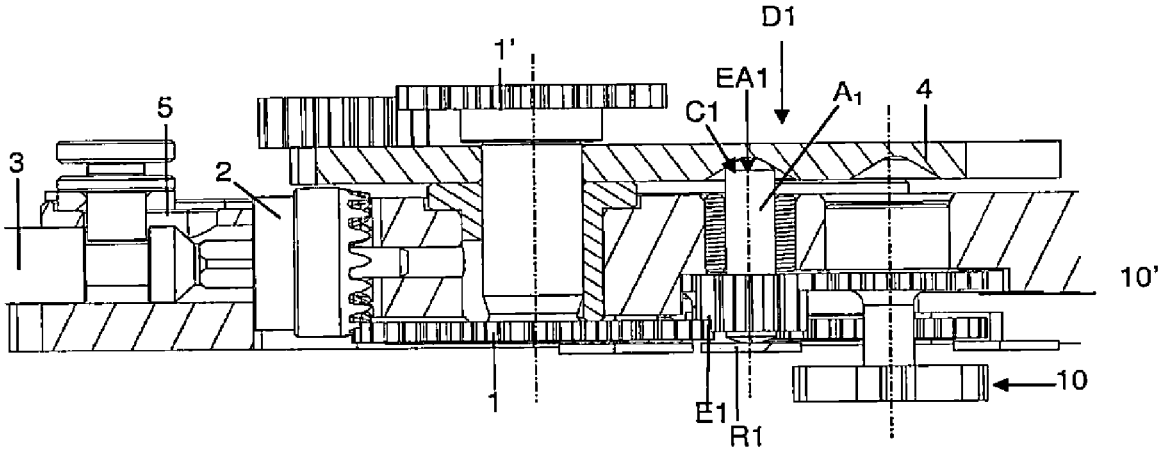

In this configuration, as depicted in FIG. 9, the extremity EA1 of the arbor A1 is situated in the recess C1 of the wheel set 4 under the influence of the return spring R1. The engagement of the wheel E1 with the wheel set for correcting the dates 10, notably the wheel 10' of the wheel set for correcting the dates 10, is established in this way.

Figure 10:
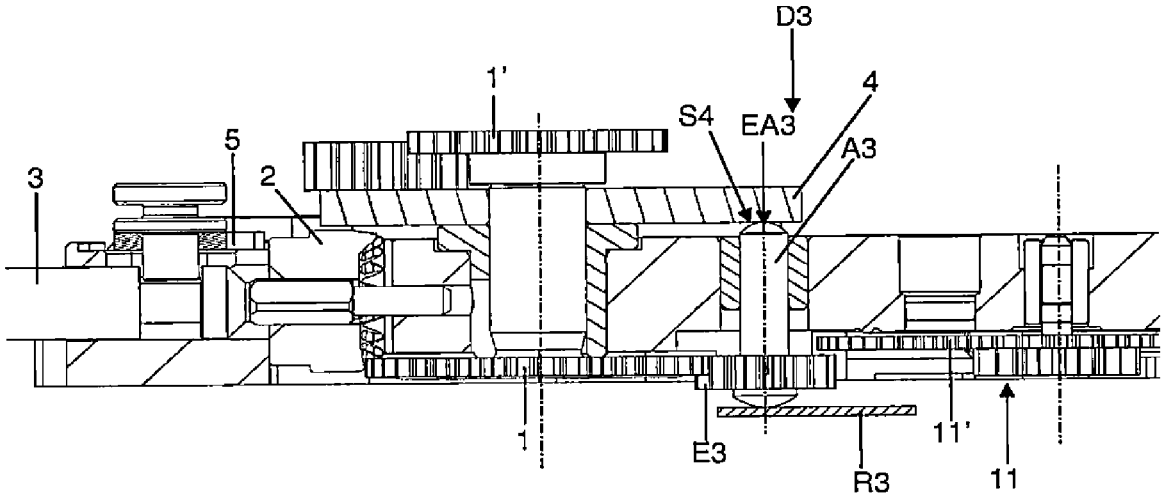

In this same configuration, the respective extremities EA2 and EA3 of the arbors A2 and A3 bear against the surface S4 of the wheel set 4. The two other correction trains are disengaged as a result. By way of example, FIG. 10 shows the disengaged train for setting the time. It should be noted that the wheel E3 in this case is out of reach of the motion work 11, notably the minute wheel 11'. The arbors thus act as followers that are returned by springs against a surface of the wheel set or against a surface of a cam.

Figure 11:
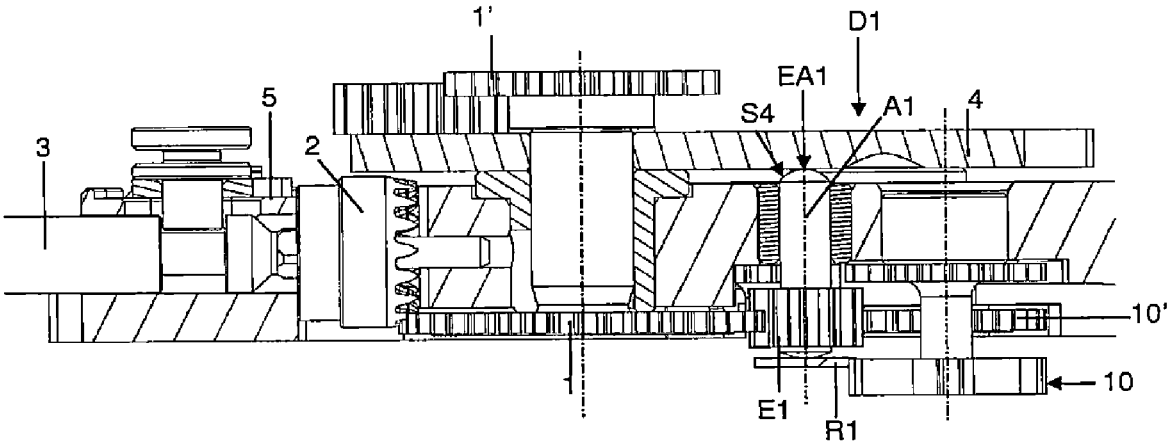

In a manner similar to what has been described above, the application of a new pulling force to the arbor 3 induces pivoting of the wheel set 4 in a first direction of rotation on an angular pitch of the toothing 40 and, by so doing, permits the disengagement of the correction train for the dates and the engagement of the correction train for a second calendar indication. FIG. 11 depicts the correction train for the dates once this has been disengaged by the actuation of the flanks F1 of the recess C1 of the wheel set 4 which have repositioned the extremity EA1 of the arbor A1 on the surface S4 of the wheel set 4 against the action of the spring R1.

Figure 12:
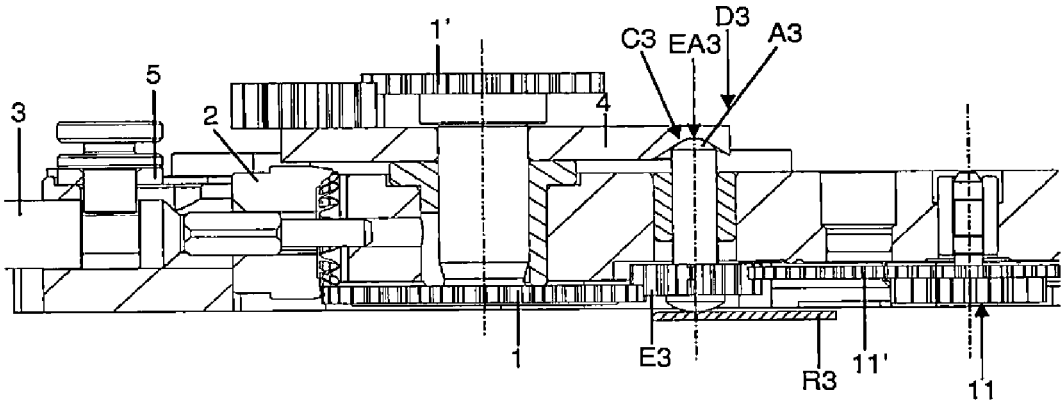

In a manner similar to what has been described above, the application of a new pulling force to the arbor induces pivoting of the wheel set 4 in a first direction of rotation on an angular pitch of the toothing 40 and, by so doing, permits the disengagement of the correction train for a second calendar indication and the engagement of the train for setting the time, as depicted in FIG. 12. In this configuration, the extremity EA3 of the arbor A3 is situated in the recess C3 of the wheel set 4 under the influence of the return spring R3. The engagement of the wheel E3 with the motion work 11, notably the minute wheel 11' of the wheel set, is established in this way.

In the embodiment described here, an axial pressure on the arbor activates the winding train of the movement, irrespective of the previously selected correction function. For this purpose, the rotation of the wheel set 4 in the first direction of rotation causes the winding of a return spring R4, of which a first extremity E1R4 is fixed to the frame element of the movement, and a second extremity E2R4 is fixed to the wheel set 4, as depicted in FIG. 5. The angular unlocking of the wheel set 4 thus causes pivoting of the wheel set 4 in a second direction of rotation under the influence of the return spring R4, until the wheel set 4 once more adopts the angular position that it occupies when the winding train of the movement is engaged. The sequential driving member, notably the finger 7 and the pawl 8, is thus intended to retract under the influence of an axial pressure exerted on the arbor. For this purpose, the pawl 8 is intended to be retracted under the influence of the second lever 6 by the interaction of the respective extremities E8 and E6. The latter returns to its position in the toothing 40 of the wheel set 4 by activation of its return spring R8.

Figure 13:
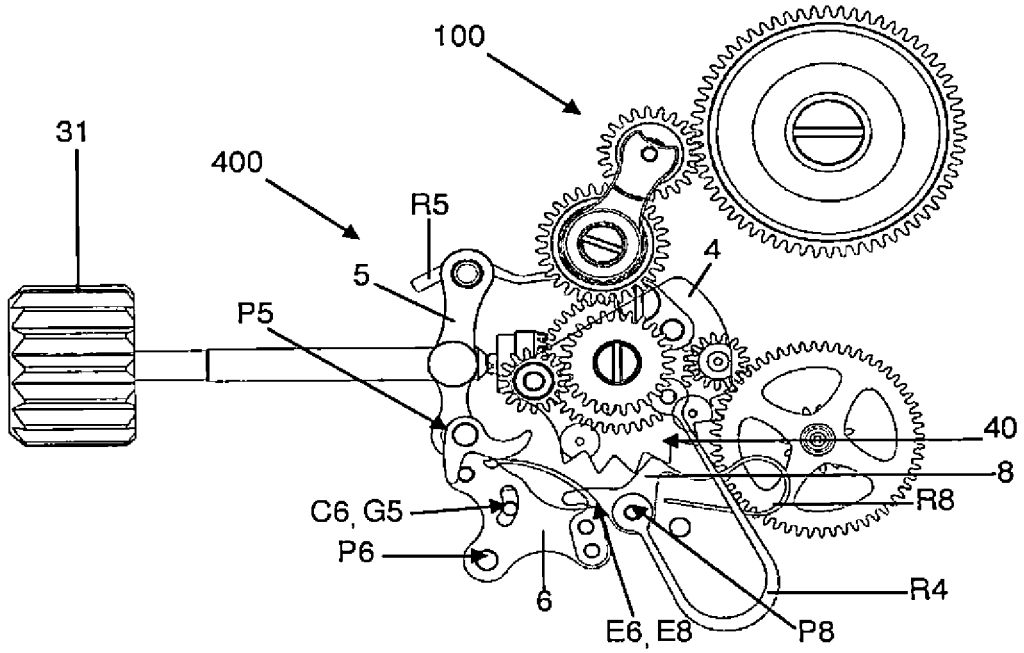
Figure 14:
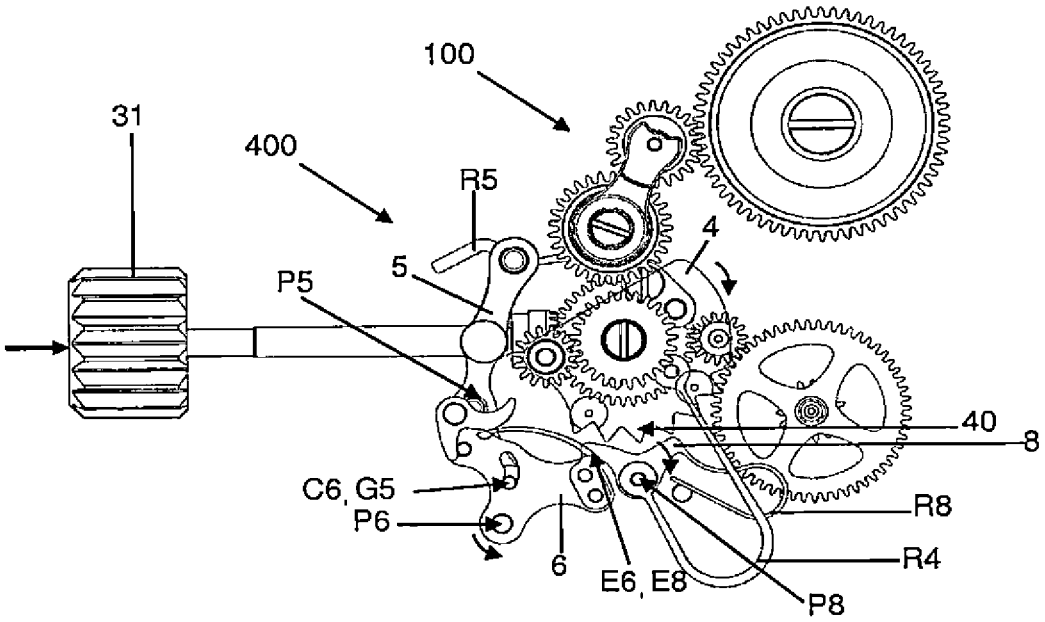
Figure 15:
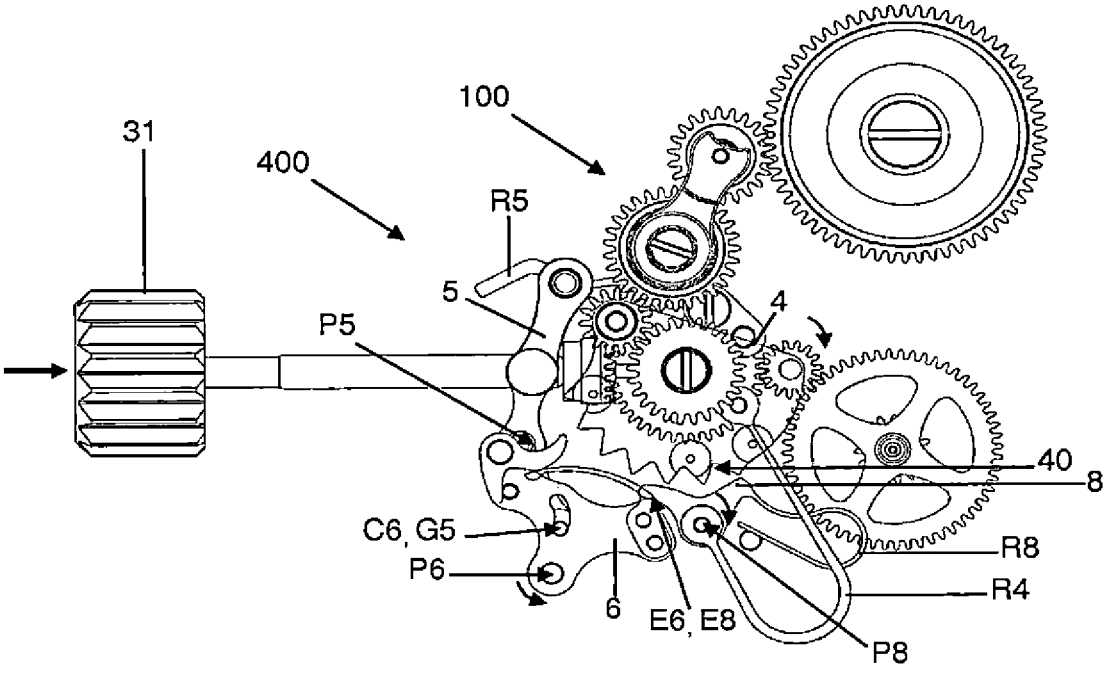

By way of example, FIGS. 13 to 15 show a sequence for the transition from the time-setting function to the winding function under the influence of a pressure exerted on the winding crown.

In an alternative variant embodiment, the wheel set 4 may be implemented, for example, by a pull-out piece provided with recesses C1, which lever may be pivotably driven by a selection device such as that described previously or by a conventional control stem having two, three or four positions. Alternatively, the wheel set 4 may similarly be pivotably driven under the influence of a selection member, which may or may not be different from the member which permits the winding and/or correction functions to be actuated, for example a bezel or a second selection stem.

The architecture of the mechanism and of the selection device permits the design of the usual mechanisms to be simplified while permitting the number of functions on the stem, notably correction functions, to be multiplied and the selection of these functions to be simplified.

The mechanism and the selection device are notably based on the implementation of vertical clutch devices so as to prevent malfunctions of the mechanisms that are familiar from the prior art. Their design makes it possible, furthermore, to achieve the implementation of particularly simple interface irrespective of the number of indications to be corrected and/or functions to be actuated. Preferably, the selection of one or other of these functions is effected by the application of successive pulling forces or pressures to a control stem and the actuation of the selected function by the rotation of said stem.

In this document, the numbers n, N and m may be independent of one another.

The expression correction function is intended to denote any adjustment function of a horological function, for example a watch indication, notably an indication derived from the time, irrespective of whether the adjustment is effected in a unidirectional or bidirectional manner.

A first member may be in direct and permanent engagement with a second member if the first member is in contact with the second member. A first member may likewise be in direct and permanent engagement with a second member by means of a third member fixed to the first member, which is in contact with the second member.

Thus, in the embodiment depicted in FIGS. 9 to 12, the control wheels 1 and 1' are fixed to one another, and the control wheel 1' is accordingly in direct and permanent contact not only with the wheel E1', but is also in direct and permanent contact with the movable member 2 and with the wheels E1, E2, E3. However, the control wheel 1' is not in contact either with the movable member 2, or with the wheels E1, E2, E3, whereas the control wheel 1 is in contact with the movable member 2 and with the wheels E1, E2, E3.

Preferably, in the different embodiments, the control member has a single and unique stable position, that is to say it is monostable. More preferably, in the different embodiments, the control member is so arranged as to select the winding function by displacement of the control member in a first direction, in particular in translation, and as to select at least two correction functions by displacement of the control member in a second direction, in particular in translation, notably a second direction different from the first direction, or opposite to the first direction.

In the whole of this document, the expression sequential selection of functions is intended to denote preferably that the different functions are selected successively in a predetermined order, in particular according to the direction of displacement of the control member. This order is not modifiable for a given direction of displacement of the control member. Thus, in a sequential selection of three functions A, B and C, if the order of sequential selection of the functions is A, B, C, then:

if the function A is selected initially, the act of modifying the selection, in particular by a second direction of displacement of the control member, may result only in the selection of the function B;

if the function B is selected initially, the act of modifying the selection, in particular by a second direction of displacement of the control member, may result only in the selection of the function C.

Furthermore, provided that the function A, B or C has been selected initially, the act of displacing the control member in a first direction will result in the selection of a function D.

As described previously, the transition from selecting one function to the following function is realized by the actuation of the control member by the user, notably by the displacement of the control member in the second direction, in particular by the displacement in translation of the control member. This displacement is preferably a displacement moving the control member away from its stable position towards which the control member is biased.

The invention claimed is:

1. A device for selecting a horological function from among a winding function and m correction functions, m>1, comprising:

a control member adapted:

to select the winding function by displacement of the control member in a first direction, and to select sequentially one function from among m correction functions by displacement of the control member in a second direction, wherein the control member is monostable so that the control member is returned to a single rest position after being actuated in any of the first direction or the second direction.

2. The device as claimed in claim 1, wherein the device comprises a wheel set rotatably mounted on a frame element, of which a direction of rotation is determined by a direction of translation of the control member.

3. The device as claimed in claim 2, wherein the device comprises a member for driving the wheel set sequentially in a first direction.

4. The device as claimed in claim 3, wherein the driving member comprises a first lever, a second lever and a third lever or finger.

5. The device as claimed in claim 4, wherein the device comprises a first return spring so arranged as to return the first lever and the control member to a rest position.

6. The device as claimed in claim 4, wherein the device comprises a second return spring so arranged as to return the third lever to a rest position.

7. The device as claimed in claim 4, wherein the first lever is a pull-out piece and the third lever or finger is pivoted on the second lever.

8. The device as claimed in claim 3, wherein the wheel set comprises toothing so arranged as to interact with the sequential drive member.

9. The device as claimed in claim 8, wherein the wheel set comprises toothing so arranged as to interact with the third lever or finger.

10. The device as claimed in claim 3, wherein the device comprises a pawl for indexing the wheel set into position.

11. The device as claimed in claim 10, wherein the indexing pawl is so arranged as to interact with the second lever.

12. The device as claimed in claim 11, wherein the indexing pawl is so arranged that the actuation of the second lever on the pawl deactivates the pawl.

13. The device as claimed in claim 2, wherein the device comprises an element for returning the wheel set to a rest position.

14. The device as claimed in claim 1, wherein the control member comprises an arbor and the device is so arranged that a translatory actuation of the arbor, in a direction of pushing against the arbor, causes activation of a watch winding function, or wherein the device is so arranged that a translatory actuation of the arbor, in a pulling direction of the arbor, causes activation of a watch correction function.

15. A mechanism for performing at least one action selected from the group consisting of winding and correcting at least one horological function, comprising:

a control wheel for controlling at least one action selected from the group consisting of winding and correcting, in direct and permanent engagement respectively with a movable member and with n wheels, n>1, wherein each of the n wheels is part of a kinematic train for correction or winding, and each kinematic train comprises a respective clutch, at least n−1 of the clutches being of a vertical type, and wherein the mechanism comprises the device as claimed in claim 1.

16. The mechanism according to claim 15, wherein n>2.

17. A watch movement comprising the device as claimed in claim 1.

18. A watch comprising the device as claimed in claim 1.

19. The device as claimed in claim 1, wherein the control member comprises a stem.

* * * * *